United States Patent [19]

Miethlich et al.

[11] Patent Number: 4,895,077

[45] Date of Patent: Jan. 23, 1990

[54] PROJECTILE CORE FOR A SABOT PROJECTILE

[75] Inventors: Hansruedi Miethlich, Elgg; Nicole Chabarekh, Weisslingen, both of Switzerland

[73] Assignee: Werkzeugmaschinenfabrik Oerlikon-Bührle AG, Zurich, Switzerland

[21] Appl. No.: 356,061

[22] Filed: May 22, 1989

[30] Foreign Application Priority Data

May 24, 1988 [CH] Switzerland ..... 01953/88

[51] Int. Cl.[4] ..... F42D 13/06

[52] U.S. Cl. ..... 102/517; 102/501; 102/506; 102/518

[58] Field of Search ..... 102/517, 518, 519, 520, 102/506, 501

[56] References Cited

U.S. PATENT DOCUMENTS

| | | | |
|---|---|---|---|
| 3,213,792 | 10/1965 | Grenander et al. | 102/518 |
| 3,599,573 | 8/1971 | Sliney | 102/517 |
| 4,108,073 | 8/1978 | Davis | 102/518 |
| 4,671,180 | 6/1987 | Wallow et al. | 102/517 |

FOREIGN PATENT DOCUMENTS

| | | | |
|---|---|---|---|
| 0051375 | 5/1982 | European Pat. Off. | 102/517 |
| 0073384 | 3/1983 | European Pat. Off. . | |
| 0291845 | 11/1988 | European Pat. Off. | 102/501 |
| 734429 | 4/1943 | Fed. Rep. of Germany | 102/517 |
| 2529663 | 1/1984 | France | 102/517 |
| 305151 | 4/1955 | Switzerland . | |
| 1899 | of 1899 | United Kingdom | 102/517 |
| 579205 | 7/1946 | United Kingdom . | |

*Primary Examiner*—David H. Brown
*Attorney, Agent, or Firm*—Werner W. Kleeman

[57] ABSTRACT

It is desirable, on the one hand, to fabricate the projectile core or body of a material as frangible as possible in order to achieve a good radical effect thereof in the target. On the other hand, the material should be sufficiently ductile to enable the projectile to penetrate several armor plates. Therefore, a relatively ductile projectile-core rod is inserted in a relatively brittle projectile-core central section, such projectile-core rod being anchored at its rear end in a projectile-core tail and at its front end in a projectile-core nose or tip.

4 Claims, 1 Drawing Sheet

PROJECTILE CORE FOR A SABOT PROJECTILE

BACKGROUND OF THE INVENTION

The present invention broadly relates to armor-piercing projectiles and, more specifically, pertains to a new and improved construction of a projectile core or body for a sabot projectile.

Generally speaking, the new and improved construction of a projectile core or body for a sabot projectile comprises a projectile-core nose or tip, a projectile-core tail or tail portion and a projectile-core central or intermediate section which are connected with one another by means of a projectile-core rod or bolt. The projectile-core central or intermediate section is fabricated or formed of a relatively frangible or brittle tungsten.

As disclosed, for example, in European Pat. No. 0,051,375, published Jan. 11, 1989, it is known to use a frangible tungsten for a projectile core or body in which there is provided a bolt or shaft. In this known projectile core or body there is used for the tip as well as the bolt or shaft a pyrophoric material such as zirconium, titanium and alloys thereof. The projectile-body central or intermediate section comprises frangible tungsten or a frangible tungsten alloy having a compressive strength in excess of 15,000 kg/cm$^2$ and a tensile strength of less than 800 kg/cm$^2$.

Furthermore, an explosive body known, for example, from Swiss Pat. No. 305,149, published Apr. 16, 1955, possesses splitters embedded in a binding material or mass. The part or component containing the splitters is at least partially biased by an elastically tensioned tie or tension rod. This part or component containing the splitters is preferably a cylinder-shaped hollow body.

Furthermore, as disclosed, for example, in British Patent Application No. 2,113,810, published Aug. 10, 1983, an armor-piercing penetrator projectile has a pre-penetrator part and a main penetrator part which are connected to each other by an axial connecting element such as a bolt or tie rod.

All these known projectiles have the disadvantage that, after penetrating or piercing a first armor plate of the target, they do not possess sufficient or adequate penetrating force to penetrate a second or even a third armor plate in the target.

SUMMARY OF THE INVENTION

Therefore, with the foregoing in mind it is a primary object of the invention to provide a new and improved construction of a projectile core or body which does not exhibit the aforementioned drawbacks and shortcomings of the prior art constructions.

Another and more specific object of the present invention aims at providing a new and improved construction of a projectile core or body for a sabot projectile which is capable of penetrating a number of armor plates of a target before the projectile core or body is entirely disintegrated, thus losing all of its penetrating force.

Yet a further significant object of the present invention aims at providing a new and improved projectile core or body for a sabot projectile and which projectile core or body is of relatively simple construction and design and can be therefore relatively economically fabricated.

Now in order to implement these and still further objects of the present invention which will become more readily apparent as the description proceeds, the projectile core or body of the present invention is manifested, among other things, by the features that the projectile-core rod or bolt possesses an armor-piercing tip and is fabricated or formed of a relatively ductile armor-piercing material. For the projectile-core rod or bolt there is preferably used tungsten which is adequately ductile in order not to totally disintegrate while penetrating a first armor plate or shield of the target.

The projectile core or body constructed according to the invention has the beneficial characteristic that the armor-piercing projectile-core rod or bolt is capable of penetrating several armor plates or the like before it is decomposed into fragments and loses its piercing or penetrating force.

As a variant to the aforesaid tungsten being used for the fabrication of the projectile-core rod or bolt, the latter can be also advantageously manufactured of hard metal or carbide metal.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
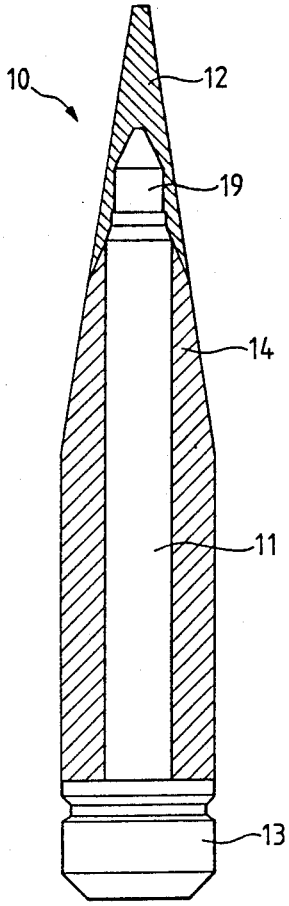
FIG. 1 shows a longitudinal sectional view of a projectile core or body constructed according to the invention.

Describing now the drawings, it is to be understood that to simplify the showing thereof, only enough of the structure of the exemplary embodiment of the projectile core or body has been shown therein as is needed to enable one skilled in the art to readily understand the underlying principles and concepts of the present invention. Turning attention now specifically to FIG. 1 of the drawings, a projectile core or body 10 illustrated therein by way of example and not limitation is depicted as the same is constructed according to the invention and comprises a projectile-core rod or bolt 11 containing an armor piercing tip 19, a projectile-core nose or tip 12, a projectile-core tail or tail portion 13 and projectile-core central or intermediate section 14.

For the individual parts or components of the projectile core or body 10 for a sabot projectile the materials listed hereinafter preferably should be used:

Frangible tungsten is particularly suitable for the projectile-core central or intermediate section or portion 14. The compressive strength of this frangible tungsten is, for example, 10 to 20 times greater than the tensile strength thereof. Therefore, this projectile-core central or intermediate section 14 must be structured such, for instance by using suitable alloys, that upon firing of the sabot projectile the projectile-core central or intermediate section 14 does not prematurely disintegrate because of its frangibility or brittleness. In the case of extremely frangible material, a bias or pre-load exerted by a tie or tension rod is required.

Suitable materials for the projectile-core nose or tip 12 are steel, zirconium, titanium, aluminum and a tungsten alloy.

Ductile tungsten, hard metal, steel and a tungsten alloy are suitable for the projectile-core tail or tail portion 13.

Ductile tungsten or hard metal or any other armor-piercing material is particularly suitable for the projectile-core rod or bolt 11, also termed tie or tension rod because it also serves to bias or pre-load the projectile-core central or intermediate section 14.

Figure 2:
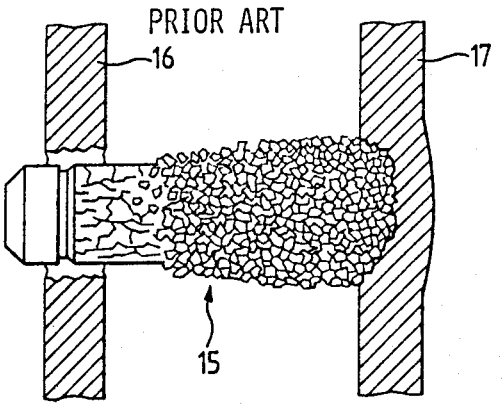
FIG. 2 shows a known or prior art projectile-core or body penetrating a target.
Figure 3:
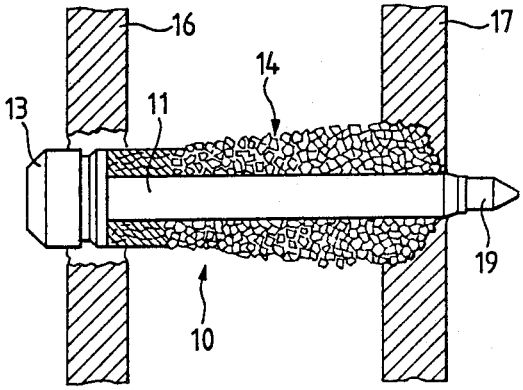
FIG. 3 shows a projectile core or body constructed according to the invention and penetrating a first and a second plate of a target.
Figure 4:
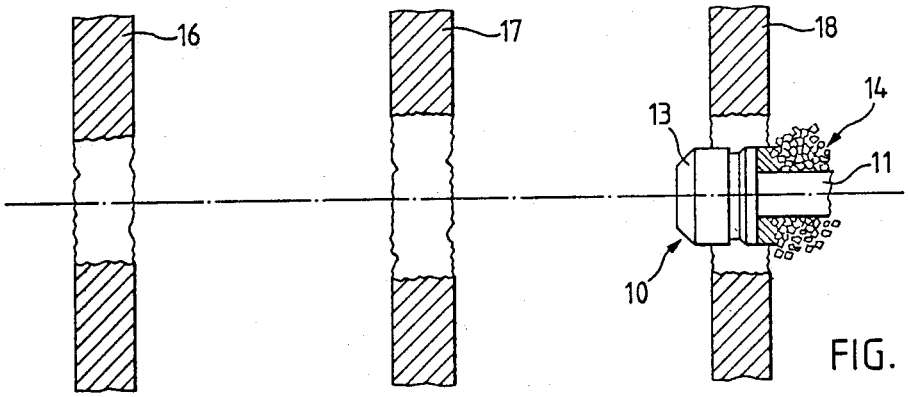
FIG. 4 shows the projectile core or body illustrated in FIG. 3 but at the moment of penetrating a third plate of the same target.

The projectile core or body 10 of the sabot projectile should be constructed to be suitable for combating targets which comprise a number of armor plates arranged in a substantially spaced relationship with respect to one another, as depicted in FIGS. 2, 3 and 4.

As will be seen in FIG. 2, a relatively frangible projectile core or body 15 as hitherto known in the ordnance art disintegrates upon penetration of a first armor plate 16 to such an extent that it is no longer capable of penetrating a second armor plate 17.

As depicted in FIG. 3, the relatively frangible or brittle projectile-core central or intermediate section 14 of the present invention is likewise decomposed into fragments upon penetration of the first armor plate 16. However, by virtue of the construction of the projectile-core rod or bolt 11 according to the teachings of the present invention, the projectile-core rod or bolt 11 is nevertheless capable of penetrating the next following second armor plate 17.

As also shown in FIG. 4, the projectile-core rod or bolt 11 is already substantially smaller after penetration of the second armor plate 17 but, nevertheless, the projectile core or body 10 constructed according to the invention is still capable of penetrating yet a third armor plate 18.

As is apparent from FIGS. 2 to 4 and from the above description of the projectile-core rod or bolt 11, the projectile core or body 10 constructed according to the invention is particularly suitable for combating targets in which, for example, three armor plates 16, 17 and 18 or even more armor plates are arranged in tandem.

In projectile cores or bodies hitherto known to the art there has been used brittle tungsten, so-called frangible tungsten with an elasticity of elongation of practically 0%, which is arranged between the ballistic projectile-core nose or tip 12 and the projectile-core tail or tail portion 13. By means of such a known projectile core or body the desired end-ballistic effect or action is only achieved in a relatively "soft" target. This known projectile core or body is not capable of penetrating inhomogeneous or heterogeneous targets, i.e. targets composed of several plates arranged in a spaced relationship with respect to one another, because the brittle tungsten breaks or fractures after penetrating the first armor plate.

In a projectile core or body constructed according to the teachings of the present invention an armor-piercing projectile-core rod or bolt 11 is inserted into the interior of the brittle projectile-core central or intermediate section 14. The armor piercing projectile-core rod or bolt 11 is likewise manufactured or fabricated of tungsten, but the latter possesses a greater elasticity of elongation or flexibility in the range of, for example, 2% to 20%. This projectile-core rod or bolt 11 does not fracture or break, but continuously becomes smaller from armor plate to armor plate. It thus constitutes a typical penetrator for targets which consist of several armor plates 16, 17 and 18 arranged in a spaced relationship with respect to one another. The projectile core or body 10 thus achieves an excellent effectiveness in soft, medium hard and inhomogeneous or heterogeneous targets. Therefore, the sabot projectile is particularly suitable for ground-based air defense gun system and the like. The tip or tip portion 19 of the projectile-core rod or bolt 11 is formed to be particularly suitable for penetrating the armor plates 16 through 18.

While there are shown and described present preferred embodiments of the invention, it is to be distinctly understood that the invention is not limited thereto, but may be otherwise variously embodied and practiced within the scope of the following claims. Accordingly,

What we claim is:

1. A projectile core for a sabot projectile, comprising:
projectile-core nose;
a projectile-core tail;
a projectile-core central section located between the projectile-core nose and the projectile-core tail;
a projectile-core rod;
said projectile-core nose, said projectile-core tail and said projectile-core central section being connected to one another by said projectile-core rod;
said projectile-core central section being manufactured of relatively frangible tungsten;
said projectile-core rod possessing an armor-piercing tip; and
said projectile-core rod being formed of a relatively ductile armor-piercing material.

2. The projectile-core as defined in claim 1, wherein:
said projectile-core rod is formed of relatively ductile hard metal.

3. The projectile core as defined in claim 1, wherein:
said projectile-core rod is formed of relatively ductile tungsten.

4. The projectile core as defined in claim 1, wherein:
said relatively ductile armor-piercing material for said projectile-core rod possesses an elasticity of elongation in a range of 2% to 20%.

* * * * *